US008917878B2

(12) United States Patent
Lyu et al.

(10) Patent No.: US 8,917,878 B2
(45) Date of Patent: Dec. 23, 2014

(54) MICROPHONE INSPECTION METHOD

(71) Applicant: Primax Electronics Ltd., Neihu, Taipei (TW)

(72) Inventors: Szu-Hao Lyu, Taipei (TW); Chien-Nan Yu, Taipei (TW)

(73) Assignee: Primax Electronics Ltd., Neihu (TW)

( * ) Notice: Subject to any disclaimer, the term of this patent is extended or adjusted under 35 U.S.C. 154(b) by 302 days.

(21) Appl. No.: 13/659,686

(22) Filed: Oct. 24, 2012

(65) Prior Publication Data

US 2014/0029753 A1 Jan. 30, 2014

(30) Foreign Application Priority Data

Jul. 27, 2012 (TW) ..... 101127144 A

(51) Int. Cl.
*H04R 29/00* (2006.01)

(52) U.S. Cl.
USPC ..... 381/58; 381/122

(58) Field of Classification Search
None
See application file for complete search history.

(56) References Cited

U.S. PATENT DOCUMENTS 3,093,711 A * 6/1963 Comerci et al. ..... 381/58
2009/0290729 A1* 11/2009 Zhang ..... 381/122

* cited by examiner

*Primary Examiner* — Paul Huber
(74) *Attorney, Agent, or Firm* — Kirton McConkie; Evan R. Witt

(57) ABSTRACT

A microphone inspection method includes the following steps. Firstly, a sound wave from a speaker is received by an under-test microphone and a reference microphone. Consequently, a first characteristic point distribution chart and a second characteristic point distribution chart are created, respectively. Each of the first characteristic point distribution chart and the second characteristic point distribution chart includes plural characteristic points corresponding to respective normalized frequency values. Then, a characteristic point number difference between a number of the characteristic points of the first characteristic point distribution chart and a number of the characteristic points of the second characteristic point distribution chart within a specified normalized frequency value range is calculated. Consequently, the quality of the under-test microphone is judged according to the characteristic point number difference.

5 Claims, 6 Drawing Sheets

MICROPHONE INSPECTION METHOD

FIELD OF THE INVENTION

The present invention relates to a microphone inspection method, and more particularly to a microphone inspection method for accurately judging the quality of a microphone in the presence of background noise.

BACKGROUND OF THE INVENTION

With rapid development of video technologies, the application fields of the commercially available microphones become more expansive. For example, an electronic device such as a camcorder, a web camera or a headphone is usually equipped with a microphone for receiving sound.

For maintaining the product quality of the microphone, a quality control process is usually employed to inspect the quality of the microphone before the microphone is sold into the market. For example, an inspecting instrument is used to inspect the microphone to obtain the tested data and the tested waveform. Then, the tested data and the tested waveform are compared with the standard data and the standard waveform that are previously stored in the inspecting instrument.

However, since the microphone factory is an open place and the microphone is a sound-receiving device, the background noise resulting from the machinery operation or the noisy voice in the factory is inevitably received by the microphone. If the tested data and the tested waveform of the microphone are obtained in the factory, the tested data and the tested waveform may contain the tested data and the tested waveform of the background noise. In other words, it is not reasonable to compare the tested data and the tested waveform with the standard data and the standard waveform because the tested data and the tested waveform do not simply reflect the quality of the microphone itself but contain the background noise or other noise signals.

Furthermore, since the standard data and the standard waveform that are previously stored in the inspecting instrument, it is impossible to realize the extent of the influence of the current background noise on the inspected result of the microphone. In other words, it is not reasonable to compare the tested waveform with the standard waveform because the tested waveform does not accurately reflect the sound-receiving performance of the microphone. Under this circumstance, it is impossible to discriminate the difference between the qualified product and the unqualified product.

For solving the above drawbacks, the manufacturer of the microphone has to additionally build an anechoic chamber. The anechoic chamber is an independent soundproof testing area that is insulated from exterior sources of noise. The microphone to be inspected is disposed within the anechoic chamber to receive sound. By comparing the tested waveform of the microphone with the standard waveform, the unqualified microphone can be detected. However, since the transportation of the microphone from the factory to the anechoic chamber is labor-intensive and time-consuming, the way of inspecting the microphone in the anechoic chamber is not satisfied. Moreover, the cost of building the anechoic chamber is very high, and thus the cost associated with the microphone inspection is increased.

Therefore, there is a need of providing a microphone inspection method for accurately detecting the unqualified microphone even in the presence of background noise (e.g. in a factory) in order to increase the inspecting efficiency.

SUMMARY OF THE INVENTION

The present invention provides a microphone inspection method. Firstly, a reference microphone that has been inspected as a qualified microphone and an under-test microphone are provided to simultaneously receive sound. Consequently, two waveforms of the two microphones are respectively detected. Then, a function transformation process is implemented to create two characteristic point distribution charts. Then, a characteristic point number difference between the two characteristic point distribution charts within a specified normalized frequency value range is calculated. According to the characteristic point number difference, the under-test microphone is judged as a qualified product or an unqualified product.

In accordance with an aspect of the present invention, there is provided a microphone inspection method. The microphone inspection method includes the following steps. Firstly, an under-test microphone, a reference microphone and a processing unit are provided, wherein the under-test microphone and the reference microphone are in communication with the processing unit. Then, a speaker is provided to issue a sound wave, so that the sound wave is received by the under-test microphone and the reference microphone. After the sound wave is received by the under-test microphone, the under-test microphone issues a first digital signal to the processing unit, and the processing unit creates a first characteristic point distribution chart according to the first digital signal. After the sound wave is received by the reference microphone, the reference microphone issues a second digital signal to the processing unit, and the processing unit creates a second characteristic point distribution chart according to the second digital signal. Moreover, each of the first characteristic point distribution chart and the second characteristic point distribution chart includes plural characteristic points corresponding to respective normalized frequency values. Then, a characteristic point number difference between a number of the characteristic points of the first characteristic point distribution chart and a number of the characteristic points of the second characteristic point distribution chart within a specified normalized frequency value range is calculated, and the quality of the under-test microphone is judged according to the characteristic point number difference. If the characteristic point number difference is smaller than a threshold value, the under-test microphone is judged as a qualified product. Whereas, if the characteristic point number difference is large than the threshold value, the under-test microphone is judged as an unqualified product.

In an embodiment, the processing unit includes a chip module and an application program module. The step (b) includes a sub-step (b1) of: receiving the first digital signal and transmitting the first digital signal to the application program module by the chip module, so that a first waveform is created. Moreover, the first waveform is transformed into the first characteristic point distribution chart by a function transformation process.

In an embodiment, after the sub-step (b1), the step (b) further includes a sub-step (b2) of: receiving the second digital signal and transmitting the second digital signal to the application program module by the chip module, so that a second waveform is created. Moreover, the second waveform is transformed into the second characteristic point distribution chart by the function transformation process.

In an embodiment, the function transformation process is implemented by a Fourier transform or a wavelet transform.

In an embodiment, the sound wave issued by the speaker has a frequency of 1 k Hz.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

As previously described, the conventional microphone inspection method should be performed in an insulated room such as an anechoic chamber. On the other hand, the microphone inspection method of the present invention can be performed in an open place with background noise. For example, by the microphone inspection method of the present invention, the quality of the microphone can be inspected in a manufacturing factory.

Figure 1:
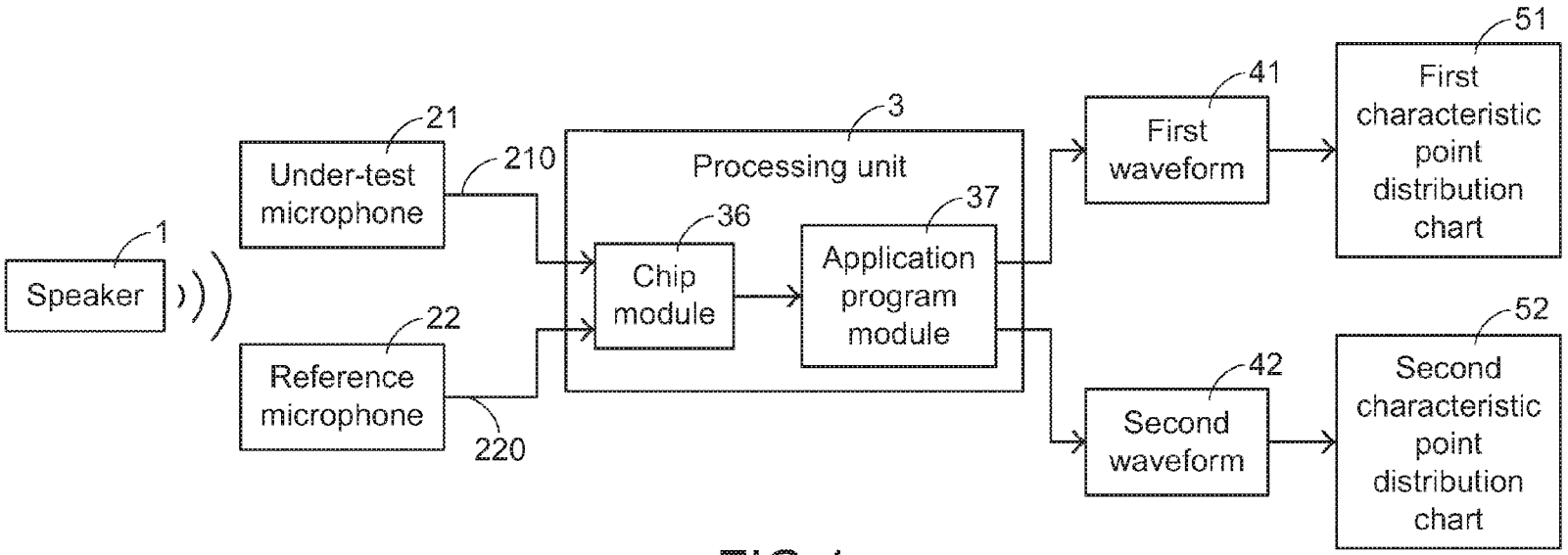
FIG. 1 is a schematic functional block diagram illustrating a microphone inspection method according to an embodiment of the present invention.
Figure 2:
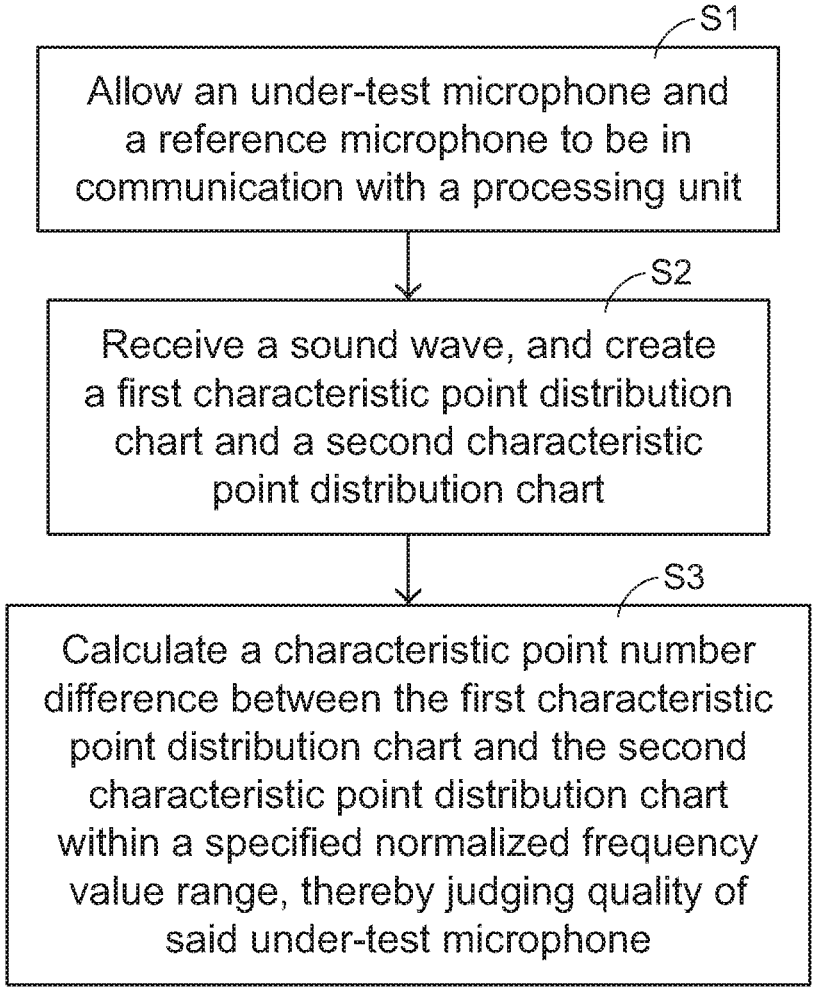
FIG. 2 is a flowchart illustrating a microphone inspection method according to an embodiment of the present invention.

FIG. 1 is a schematic functional block diagram illustrating a microphone inspection method according to an embodiment of the present invention. FIG. 2 is a flowchart illustrating a microphone inspection method according to an embodiment of the present invention. Please refer to FIGS. 1 and 2. Firstly, in the step S1, an under-test microphone 21, a reference microphone 22, and a processing unit 3 are provided. The under-test microphone 21 and the reference microphone 22 are in communication with the processing unit 3. The under-test microphone 21 is a new product microphone to be inspected. For example, the under-test microphone 21 is a microphone that is newly fabricated in the production line. The reference microphone 22 is a qualified microphone that has been inspected. In accordance with the present invention, the under-test microphone 21 and the reference microphone 22 are located in the same environment to receive sound at the same time. Later, the contents of the sound-receiving results of the under-test microphone 21 and the reference microphone 22 are compared with each other in order to judge whether the under-test microphone 21 has the sound-receiving performance equivalent to the reference microphone 22.

Next, in the step S2, a speaker 1 is provided. The speaker 1 issues a sound wave toward the under-test microphone 21 and the reference microphone 22. Consequently, the sound wave is received by the under-test microphone 21 and the reference microphone 22. In an embodiment, the sound wave is a sound wave with a constant frequency. For example, the sound wave has the frequency of 1 k Hz. It is noted that the frequency of the sound wave is not limited to the specified frequency.

Figure 3:
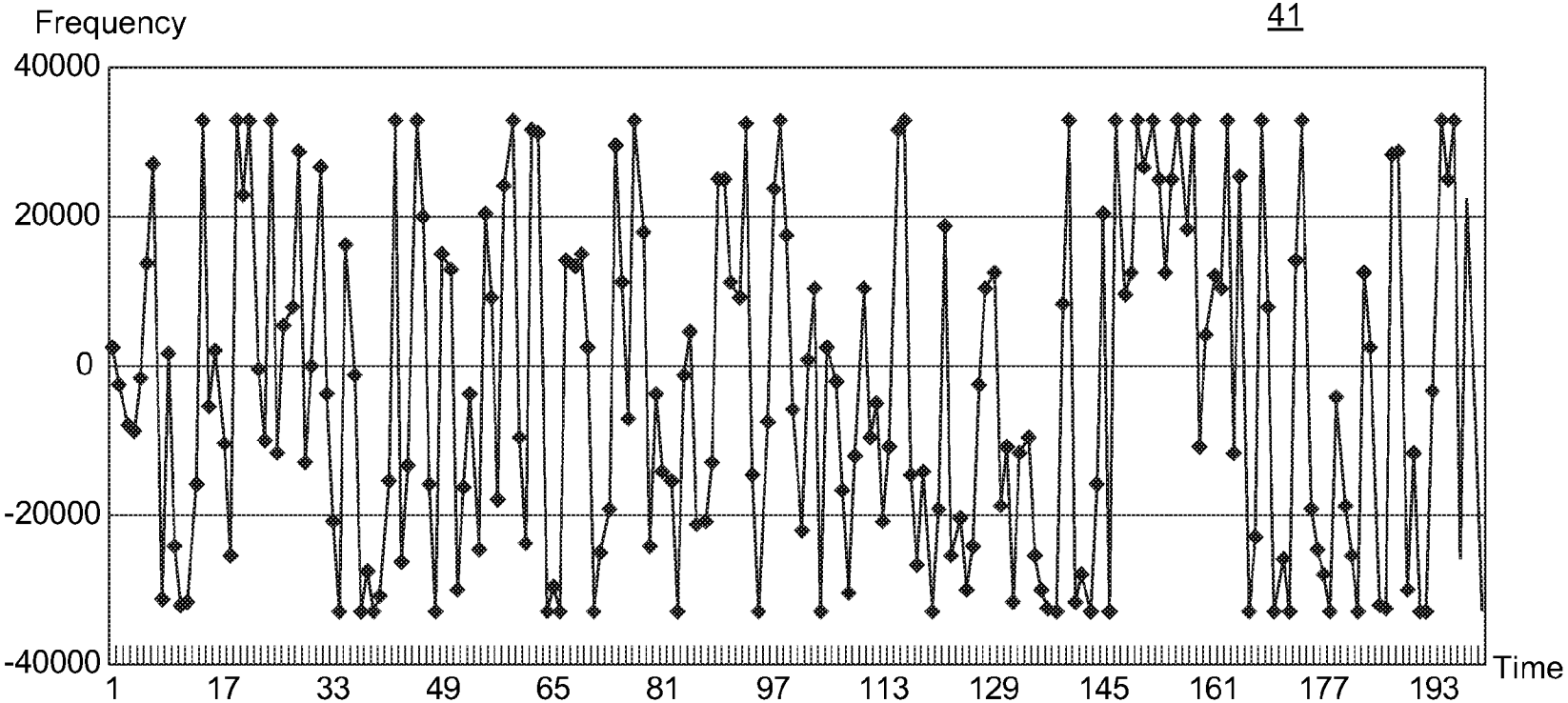
FIG. 3 is a schematic timing waveform diagram illustrating a first waveform of the under-test microphone obtained by the microphone inspection method of the present invention.
Figure 4:
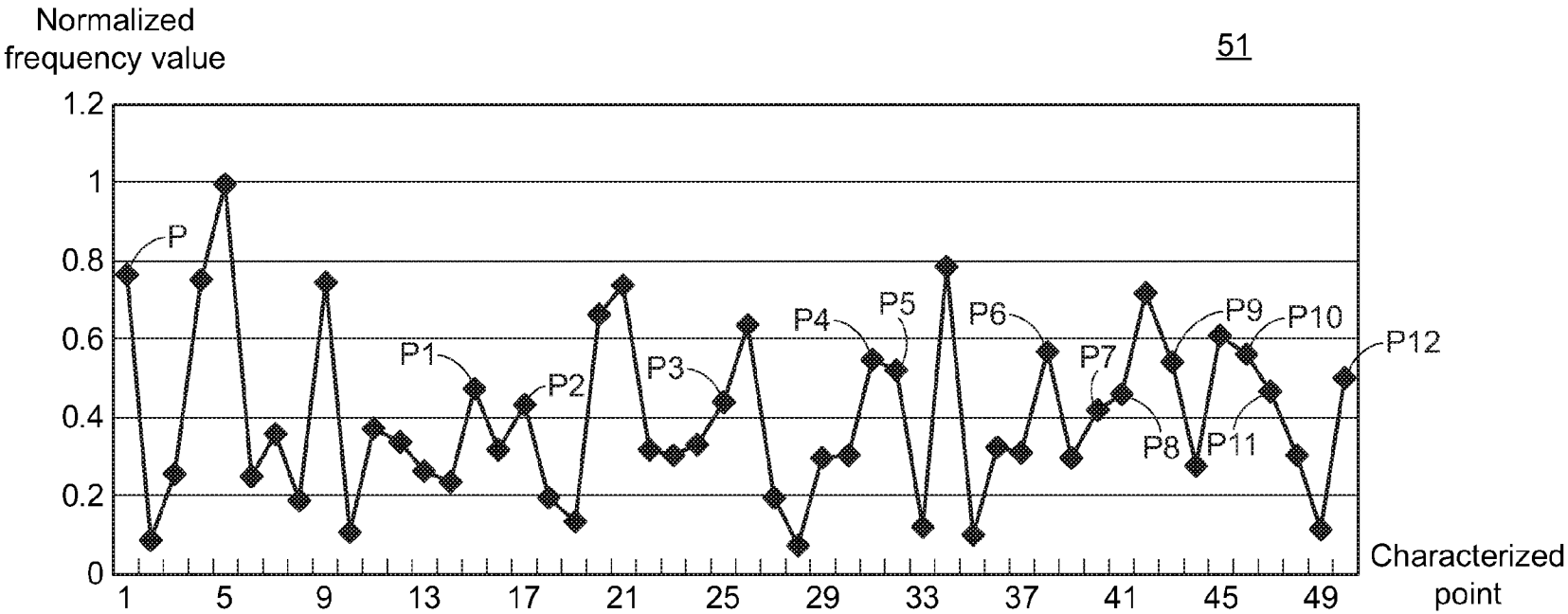
FIG. 4 schematically illustrates a first characteristic point distribution chart obtained by the microphone inspection method of the present invention.

FIG. 3 is a schematic timing waveform diagram illustrating a first waveform of the under-test microphone obtained by the microphone inspection method of the present invention. FIG. 4 schematically illustrates a first characteristic point distribution chart obtained by the microphone inspection method of the present invention. Please refer to FIGS. 1~4. After the sound wave is received by the under-test microphone 21, the under-test microphone 21 issues a first digital signal 210 to the processing unit 3. According to the first digital signal 210, the processing unit 3 creates a first characteristic point distribution chart 51.

Figure 5:
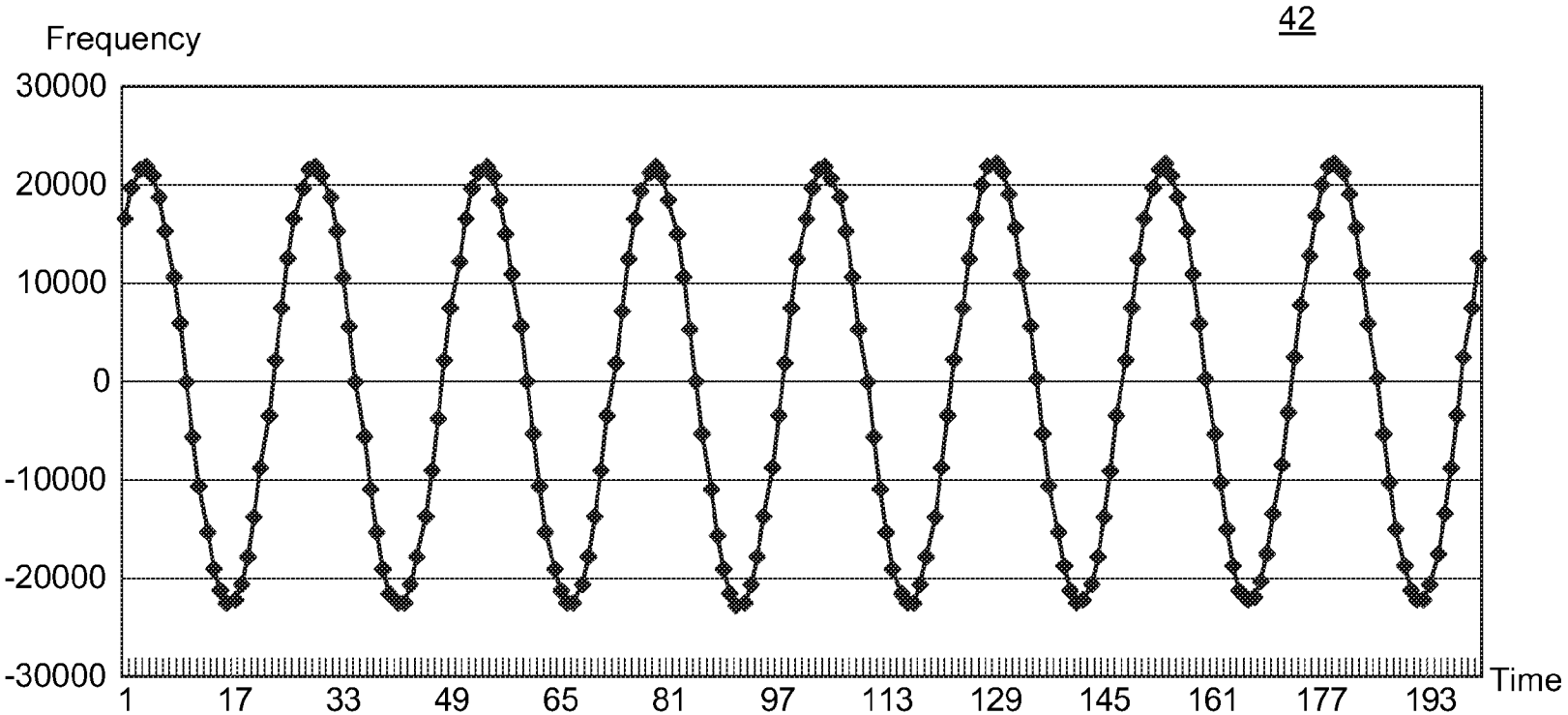
FIG. 5 is a schematic timing waveform diagram illustrating a second waveform of the reference microphone obtained by the microphone inspection method of the present invention.
Figure 6:
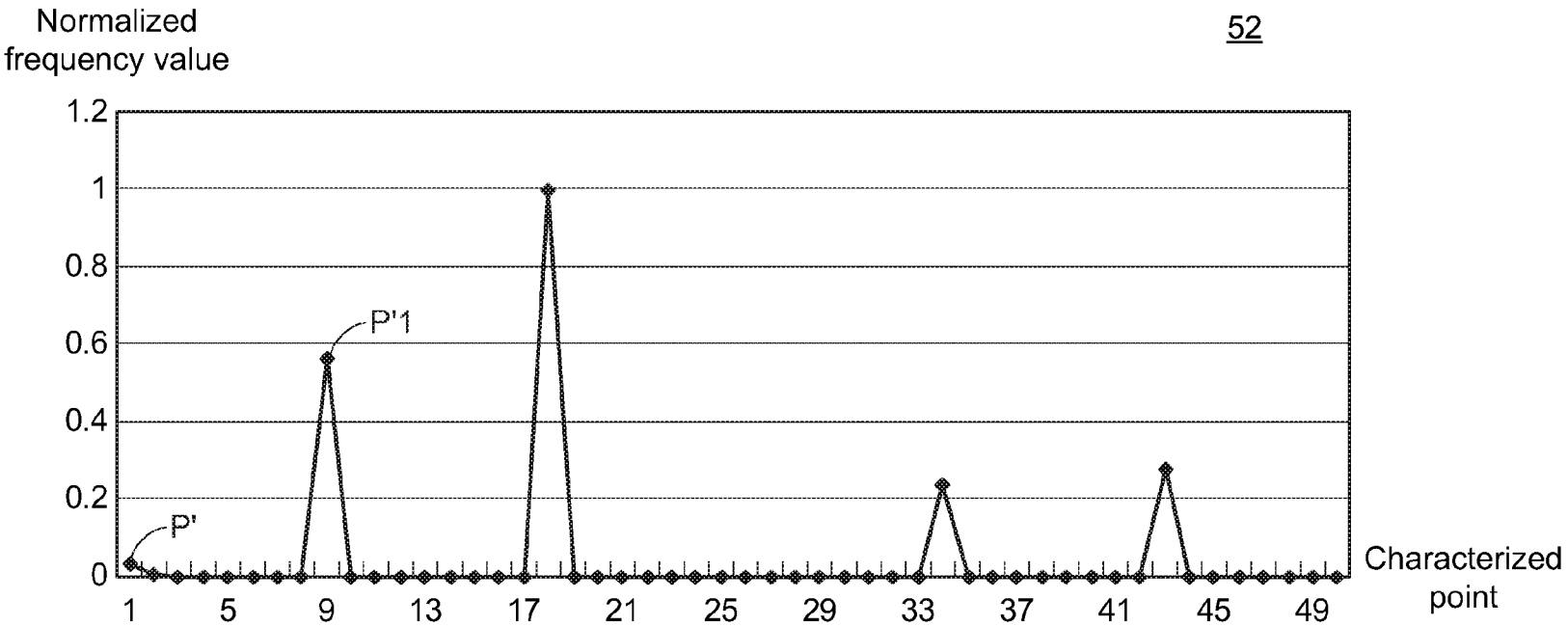
FIG. 6 schematically illustrates a second characteristic point distribution chart obtained by the microphone inspection method of the present invention.

Similarly, please refer to FIGS. 5 and 6. FIG. 5 is a schematic timing waveform diagram illustrating a second waveform of the reference microphone obtained by the microphone inspection method of the present invention. FIG. 6 schematically illustrates a second characteristic point distribution chart obtained by the microphone inspection method of the present invention. After the sound wave is received by the reference microphone 22, the reference microphone 22 issues a second digital signal 220 to the processing unit 3. According to the second digital signal 220, the processing unit 3 creates a second characteristic point distribution chart 52.

The ways of creating the first characteristic point distribution chart 51 and the second characteristic point distribution chart 52 will be illustrated in more details as follows. Please refer to FIGS. 1~6. In particular, the processing unit 3 comprises a chip module 36 and an application program module 37. After the first digital signal 210 is received by the chip module 36, the chip module 36 transmits the first digital signal 210 to the application program module 37, thereby generating a first waveform 41 (see FIG. 3). In the first waveform 41, the horizontal axis denotes time, and the vertical axis denotes frequency. Then, the first waveform 41 is transformed into plural recognizable and comparable characteristic points P by a function transformation process. Accordingly, the first characteristic point distribution chart 51 as shown in FIG. 4 is created. In the first characteristic point distribution chart 51, the horizontal axis denotes the characteristic points, and the vertical axis denotes the normalized frequency values. In other words, each characteristic point of the first characteristic point distribution chart 51 is correlated with a corresponding normalized frequency value. Similarly, after the second digital signal 220 is received by the chip module 36, the chip module 36 transmits the second digital signal 220 to the application program module 37, thereby generating a second waveform 42 (see FIG. 5). In the second waveform 42, the horizontal axis denotes time, and the vertical axis denotes frequency. Then, the second waveform 42 is transformed into plural recognizable and comparable characteristic points P' by the function transformation process. Accordingly, the second characteristic point distribution chart 52 as shown in FIG. 6 is created. In the second characteristic point distribution chart 52, the horizontal axis denotes the characteristic points, and the vertical axis denotes the normalized frequency values. In other words, each characteristic point of the second characteristic point distribution chart 52 is correlated with a corresponding normalized frequency value.

In the microphone inspection method of the present invention, the function transformation process may be implemented by a Fourier transform or a wavelet transform. Moreover, any other function transform process for transforming the waveform of the microphone from a time-domain representation to a frequency-domain representation may also be used in the microphone inspection method of the present invention.

Next, the step S3 is performed. In the step S3, a characteristic point number difference between the number of the characteristic points of the first characteristic point distribution chart 51 and the number of the characteristic points of the second characteristic point distribution chart 52 within a specified normalized frequency value range is calculated. According to the characteristic point number difference, the quality of the under-test microphone 21 is determined. For example, if the characteristic point number difference is smaller than a threshold value, the under-test microphone 21 is judged as a qualified product. Whereas, if the characteristic point number difference is large than the threshold value, the under-test microphone 21 is judged as an unqualified product.

Please refer to FIGS. 4 and 6 again. The first characteristic point distribution chart 51 as shown in FIG. 4 comprises 50 characteristic points P, and these 50 characteristic points P have respective normalized frequency values corresponding to the vertical axis. The second characteristic point distribution chart 52 as shown in FIG. 6 also comprises 50 characteristic points P', and these 50 characteristic points P' have respective normalized frequency values corresponding to the vertical axis. Then, the inspector may designate a specified normalized frequency value range as a judging range. Then, the characteristic point number difference between the number of the characteristic points of the first characteristic point distribution chart 51 and the number of the characteristic points of the second characteristic point distribution chart 52 within the judging range is calculated. For example, the judging range between 0.4 and 0.6 may be defined as the specified normalized frequency value range. In addition, the under-test microphone 21 with the characteristic point number difference smaller than or equal to 7 is judged as the qualified product, but the under-test microphone 21 with the characteristic point number difference larger than 7 is judged as the unqualified product. As shown in FIG. 4, there are twelve characteristic points P of the first characteristic point distribution chart 51 within the specified normalized frequency value range between 0.4 and 0.6, and these twelve characteristic points P are denoted as P1~P12. As shown in FIG. 6, there is one characteristic point P' of the second characteristic point distribution chart 52 within the specified normalized frequency value range between 0.4 and 0.6, and the characteristic point P' denoted as P'1. The characteristic point number difference is 11, which is larger than 7. Consequently, in this example, the under-test microphone 21 is judged as the unqualified product. It is noted that the specified normalized frequency value range and the threshold value are presented herein for purpose of illustration and description only.

From the above descriptions, the present invention provides a microphone inspection method. An under-test microphone and a reference microphone are simultaneously provided to receive sound. By comparing the contents of the sound-receiving results of the under-test microphone and the reference microphone, the quality of the under-test microphone can be effectively judged. In such way, the inspection result is not interfered by the background noise resulting from the machinery operation or the noisy voice. Consequently, the microphone inspection method of the present invention can be performed in an open place (e.g. a manufacturing factory). After the microphone is fabricated in the production line, it is not necessary to transport the microphone to the anechoic chamber. That is, the microphone can be immediately inspected in the location beside the production line. As a consequence, the overall inspecting efficiency is largely enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A microphone inspection method, comprising steps of:

(a) providing an under-test microphone, a reference microphone and a processing unit, wherein said under-test microphone and said reference microphone are in communication with said processing unit;

(b) providing a speaker to issue a sound wave, so that said sound wave is received by said under-test microphone and said reference microphone, wherein after said sound wave is received by said under-test microphone, said under-test microphone issues a first digital signal to said processing unit, and said processing unit creates a first characteristic point distribution chart according to said first digital signal, wherein after said sound wave is received by said reference microphone, said reference microphone issues a second digital signal to said processing unit, and said processing unit creates a second characteristic point distribution chart according to said second digital signal, wherein each of said first characteristic point distribution chart and said second characteristic point distribution chart comprises plural characteristic points corresponding to respective normalized frequency values; and (c) calculating a characteristic point number difference between a number of said characteristic points of said first characteristic point distribution chart and a number of said characteristic points of said second characteristic point distribution chart within a specified normalized frequency value range, and judging quality of said under-test microphone according to said characteristic point number difference, if said characteristic point number difference is smaller than a threshold value, said under-test microphone is judged as a qualified product, wherein if said characteristic point number difference is large than said threshold value, said under-test microphone is judged as an unqualified product.

2. The microphone inspection method according to claim 1, wherein said processing unit comprises a chip module and an application program module, and said step (b) comprises a sub-step (b1) of: receiving said first digital signal and transmitting said first digital signal to said application program module by said chip module, so that a first waveform is created, wherein said first waveform is transformed into said first characteristic point distribution chart by a function transformation process.

3. The microphone inspection method according to claim 2, wherein after said sub-step (b1), said step (b) further comprises a sub-step (b2) of: receiving said second digital signal and transmitting said second digital signal to said application program module by said chip module, so that a second waveform is created, wherein said second waveform is transformed into said second characteristic point distribution chart by said function transformation process.

4. The microphone inspection method according to claim 3, wherein said function transformation process is implemented by a Fourier transform or a wavelet transform.

5. The microphone inspection method according to claim 1, wherein said sound wave issued by said speaker has a frequency of 1 k Hz.

* * * * *